United States Patent [19]

Shull

[11] Patent Number: 4,877,180

[45] Date of Patent: Oct. 31, 1989

[54] MAILBOX SIGNALLING APPARATUS

[76] Inventor: James A. Shull, P.O. Box 299, Butlerville, Ind. 47223

[21] Appl. No.: 338,321

[22] Filed: Apr. 17, 1989

[51] Int. Cl.[4] ..... B65D 91/00; A47G 29/12

[52] U.S. Cl. ..... 232/35; 232/17

[58] Field of Search ..... 232/35, 34, 17

[56] References Cited

U.S. PATENT DOCUMENTS 4,072,265 2/1978 Jones ..... 232/35

*Primary Examiner*—Robert W. Gibson, Jr.

*Attorney, Agent, or Firm*—Willian Brinks Olds Hofer Gilson & Lione

[57] ABSTRACT

A mailbox signalling apparatus for rural-type mailboxes to indicate when a mailbox has been serviced. The signalling apparatus comprises a base for supporting a mailbox, a first indicator member support means on the base for supporting an indicator member toward the front end of the mailbox, a second indicator member support means on the base for supporting an indicator member toward the back end of the mailbox, an indicator member selectively supported by one of the first or second indicator member support means for movement between a first, stand-by position and a second, signalling position, and actuating means on the base for actuating the indicator member for movement from the first, stand-by position to the second, signalling position when the mailbox is opened. With the signalling apparatus of the present invention, the indicator member can be selectively positioned on the base so as to be visible from a mail patron's house irrespective of whether the mailbox is located on the same side of or across the street from the patron's house.

18 Claims, 2 Drawing Sheets

MAILBOX SIGNALLING APPARATUS

BACKGROUND OF THE INVENTION

The present invention relates generally to a mailbox signalling apparatus; and, more particularly, to a signalling apparatus for rural-type mailboxes to indicate when a mailbox has been serviced.

Rural-type mailboxes are usually positioned along one or both sides of a street to permit a mailman to deliver mail to or remove mail from the mailboxes without leaving his vehicle. Although convenient to the mailman, this is usually not convenient to mail patrons as they must generally leave their house and walk to their mailbox to retrieve their mail.

Often, mail patrons walk to their mailbox only to discover that the mail has not yet been delivered or that no mail has been delivered on that particular day. These unnecessary trips can be quite annoying, particularly during cold or inclement weather.

In an effort to eliminate unnecessary trips to the mailbox, attempts have been made to provide a signalling device capable of indicating when a mailbox has been serviced, i.e., that mail has been delivered to or removed from the mailbox. Examples of known signalling devices are disclosed in U.S. Pat. Nos. 2,613,031; 2,864,553; 3,559,878; 4,066,209; 4,344,559; 4,382,541; 4,706,880; and 4,771,941.

Known signalling devices typically include a flap or other indicator member mounted on or incorporated into a mailbox, and structure for causing the indicator member to move to a visible signalling position when the mailbox door is opened. By observing the indicator member in the signalling position, for example, from his house, a mail patron can tell that his mailbox has been serviced before he walks to the mailbox.

Known signalling devices, however, are not fully satisfactory. Many are complex in design, and are thus costly to buy, difficult to assemble and low in reliability. Frequently also, the components of many known devices are, at least partially, exposed; and are thus subject to rapid deterioration from the weather or are susceptible to being vandalized by children or other persons.

Additionally, in most signalling devices, the indicator member cannot be readily seen from all directions. In particular, mailboxes are sometimes located on the same side of the street as the house of the mail patron such that the rear of the mailbox is visible to the patron from his house. At other times, the mailbox is positioned across the street from the house of the patron such that the front of the mailbox is visible from the house. In most signalling devices, the indicator member is readily visible from only one side of the mailbox, usually the front side of the mailbox, and is partially or fully blocked by the mailbox support post or by other means when attempted to be viewed from other directions.

SUMMARY OF THE INVENTION

The present invention provides a mailbox signalling apparatus which is simple in design and easy to assemble, and which includes an indicator member which can be selectively positioned to be visible to a mail patron from his house or another location irrespective of whether his mailbox is on the same side of or across the street from his house.

The mailbox signalling apparatus of the present invention is adapted to be used with a conventional rural-type mailbox having a front end and a back end and a closure member mounted on the front end which is adapted to be pivotally moved from a closed position to an open position. The signalling apparatus comprises a base for supporting the mailbox, a first indicator member support means on the base for supporting an indicator member toward the front end of the mailbox, a second indicator member support means on the base for supporting an indicator member toward the back end of the mailbox, an indicator member selectively supported by one of the first or second indicator member support means for movement between a first, stand-by position and a second, signalling position, and actuating means on the base for actuating the indicator member for movement from the first, stand-by position to the second, signalling position when the closure member is pivotally moved from the closed position to the open position.

In accordance with a presently preferred embodiment, the indicator member comprises a rectangular-shaped plate or flap which is selectively mounted to either the first or the second indicator member support means depending on the particular requirements of the mail patron. For example, if the mailbox is on the same side of the street as the patron's house such that the back of the mailbox normally faces the house, the indicator member is normally mounted to the second indicator member support means so as to be clearly visible from the house when in the second signalling position. On the other hand, if the mailbox is located across the street from the patron's house such that the front of the mailbox faces the house, the indicator member is normally mounted to the first indicator member support means. Thus, with the present invention, the indicator member will always be readily visible to the mail patron from his house or from any other desired location irrespective of the position of the mailbox relative to his house or other desired location.

In accordance with a further aspect of the invention, the indicator member is normally retained in a first, substantially horizontal, stand-by position against the lower surface of the mailbox base by magnets affixed to the indicator member and to the lower surface of the base. The actuating means includes an actuating slide movable from a first, forward position to a second, rearward position by the closure member when the closure member is pivotally moved from its closed position to its open position; and first and second trigger members adapted to be operated by the slide when the slide moves from the first, forward position to the second, rearward position. The trigger members are positioned such that when they are operated by the actuating slide, the appropriate trigger member pushes the mounted indicator member downwardly to break the magnetic engagement between the magnets on the indicator member and the base allowing the indicator member to rotate to a substantially vertical signalling position readily visible to the mail patron.

A spring normally biases the actuating slide to its first, forward position such that when the mailbox closure member is returned to its closed position, the actuating slide automatically returns to its forward position. When the mail patron has retrieved his mail, he merely returns the indicator member to its horizontal, stand-by position for subsequent operation of the apparatus.

The base preferably comprises a generally rectangular-shaped member upon which a conventional rural-type mailbox is adapted to be mounted and is configured to define a chamber which is adapted to be covered by the mounted mailbox. Both the actuating slide and the first and second trigger members are supported substantially fully within the chamber and are thus well-protected from the weather and from vandalism. The first and second indicator member support means preferably comprise first and second pairs of aligned openings in the side walls of the base, and the indicator member is pivotally mounted between a selected one of the pair of openings by the mail patron during assembly of the apparatus. Mounting of the indicator member to a selected pair of openings can be accomplished quickly and easily with nothing more than a screwdriver.

The base may also include a downwardly extending post-receiving portion to mount the base to a mailbox post or may be designed for mounting on a board or other flat mailbox support surface.

Further advantages and specific features of the invention will become more readily apparent hereinafter in conjunction with the following detailed description of a presently preferred embodiment.

DETAILED DESCRIPTION OF THE PREFERRED EMBODIMENT

Figure 1:
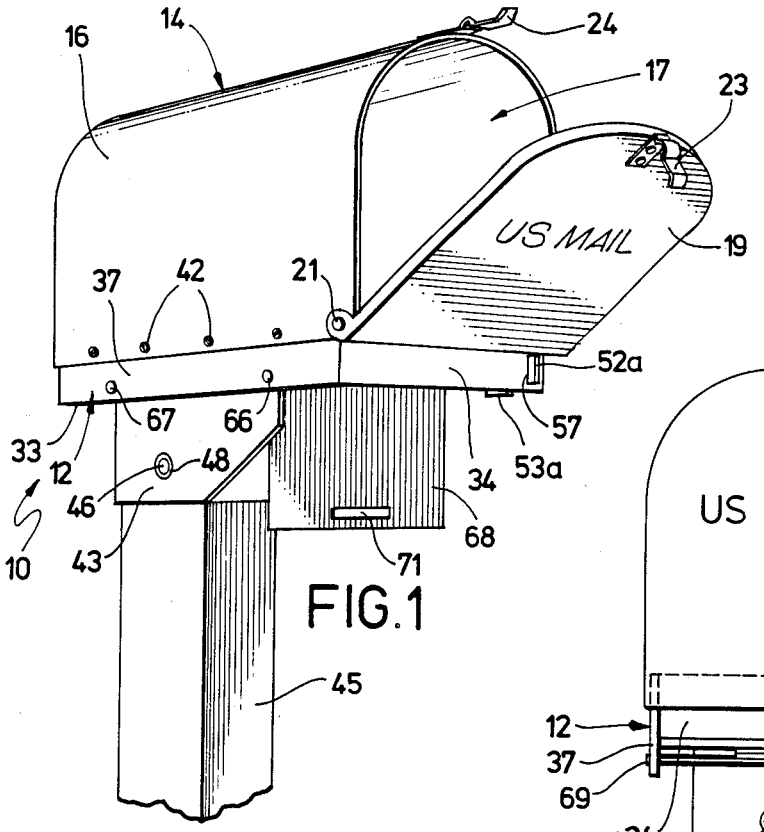
FIG. 1 is a perspective view of a mailbox signalling apparatus according to a presently preferred embodiment of the invention having a mailbox mounted thereon.
Figure 2:
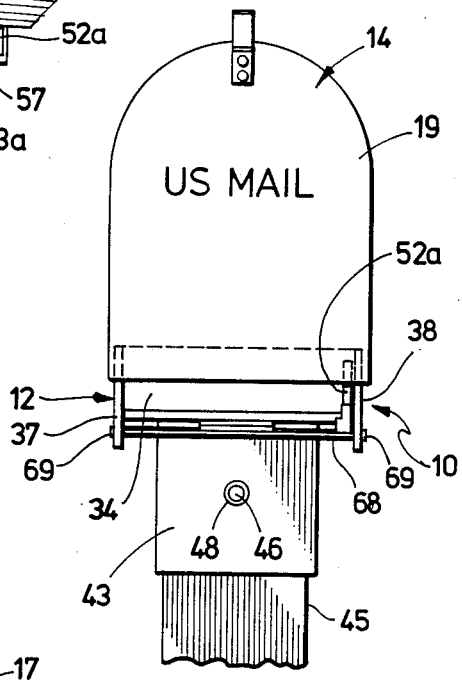
FIG. 2 is a front view of the mailbox signalling apparatus of FIG. 1 with the indicator member thereof in a stand-by position.
Figure 3:
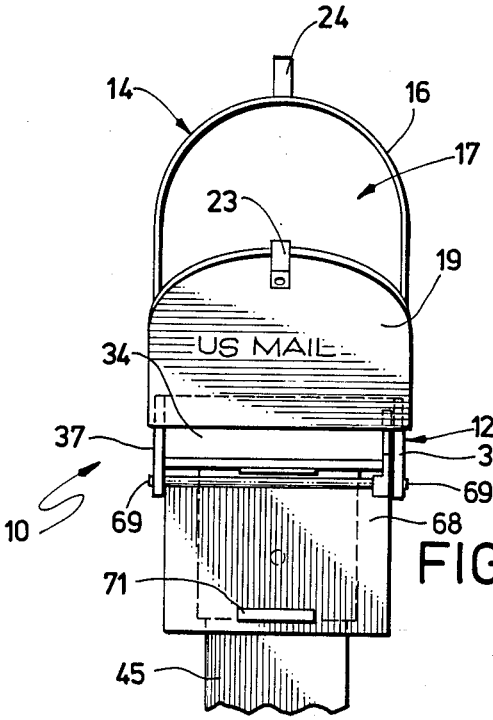
FIG. 3 is a front view of the mailbox signalling apparatus of FIG. 1 with the indicator member thereof in a signalling position.
Figure 4:
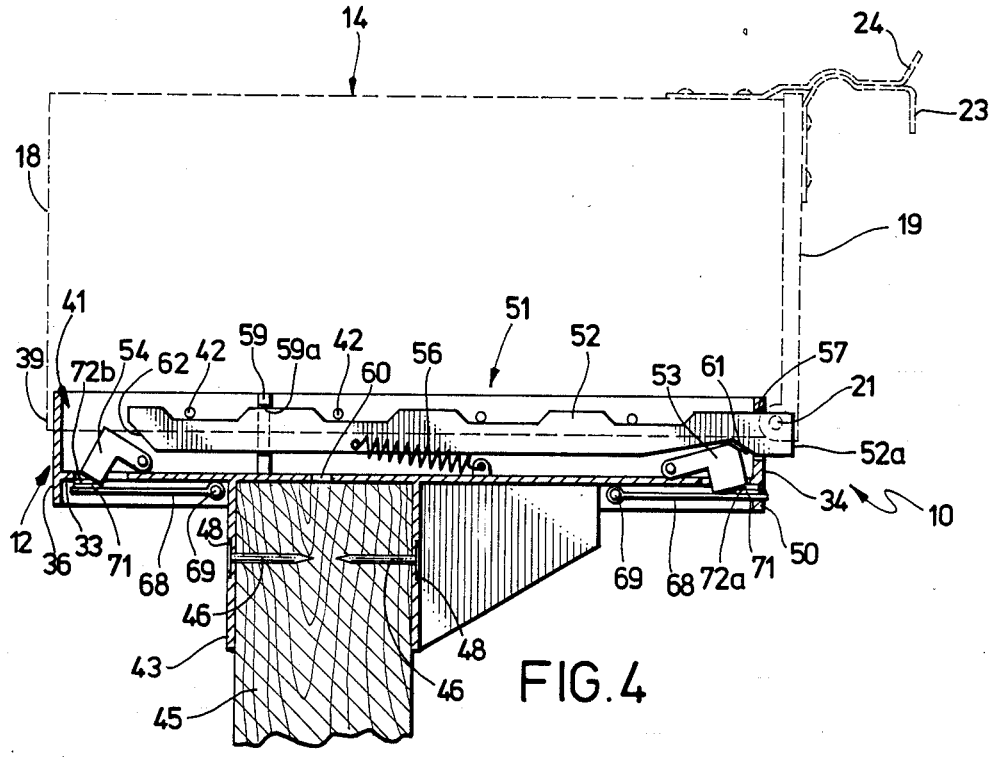
FIG. 4 is a cross-sectional side view of the mailbox signalling apparatus of FIG. 2.
Figure 5:
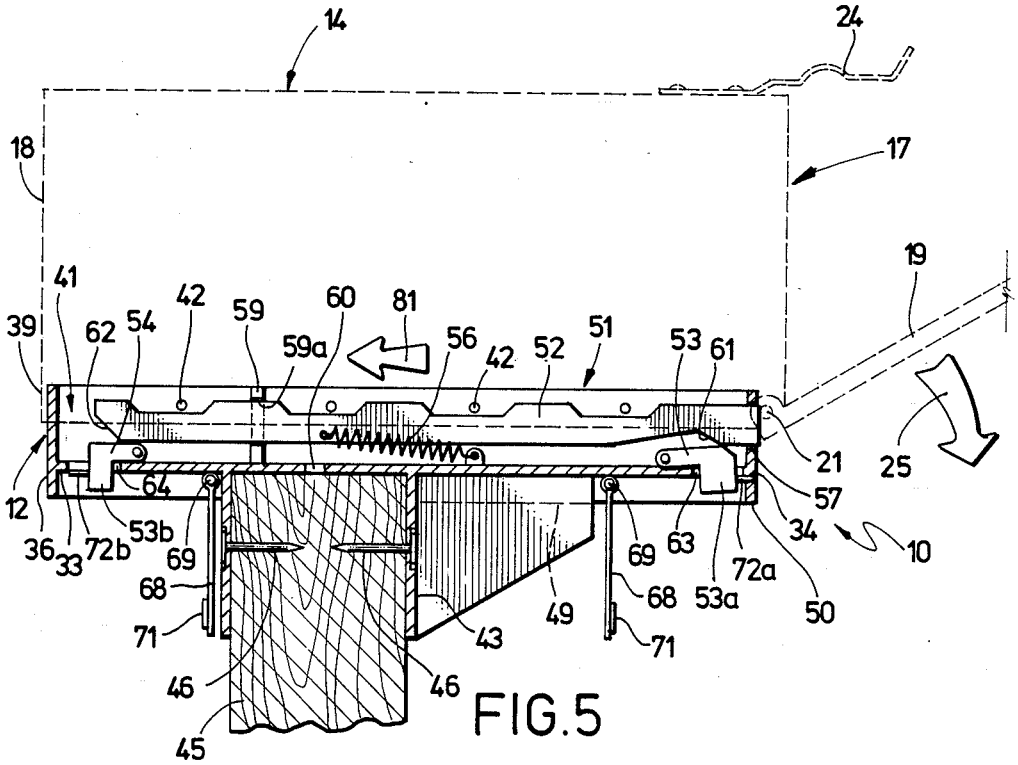
FIG. 5 is a cross-sectional side view of the mailbox signalling apparatus of FIG. 3.

FIGS. 1–5 illustrate a mailbox signalling apparatus according to a presently preferred embodiment of the invention. The signalling apparatus is generally designated by reference numeral 10 and comprises a base 12 for supporting a conventional rural-type mailbox 14. Mailbox 14 comprises a housing 16, having an open front end 17 and a closed back end 18. A closure member or door 19 is mounted to housing 12 adjacent its bottom edge for pivotal movement around axis 21 between an upright position closing the mailbox (FIGS. 2 and 4) and a down position opening the mailbox and providing access to the mailbox through open end 17 (FIGS. 1, 3 and 5). Closure member 19 includes a handle 23 to facilitate opening and closing of the mailbox, and an extension 24 on the mailbox helps to retain the door in its closed position.

Base 12 is of generally rectangular shape and includes a bottom wall 33, a front side wall 34, a back side wall 36 and lateral side walls 37 and 38. The walls of base 12 define an internal chamber 41 which is open at the top, but which is adapted to be covered by mailbox 14 when the mailbox is mounted to the base. Specifically, the side and back walls of rural-type mailboxes usually extend slightly below the base of the mailbox and define a downwardly extending skirt 39 therearound. Base 12 is sized to be received within skirt 39 and the mailbox is mounted thereto by extending screws 42 through openings in the skirt and the base. The length of the base is such that the front end of the mounted mailbox extends slightly (e.g., slightly more than three-fourths inch) beyond the front side wall 34 of the base as best shown in FIGS. 4 and 5.

A downwardly extending, post-receiving portion 43 extends from the bottom 33 of the base to receive a standard mailbox post 45 in order to mount the base and the mailbox to the post. The base can be attached to the post by extending nails 46 or the like through openings in the post-receiving portion and into post 45. Preferably, the openings are formed with an internal shoulder to permit washers 48 to be received therein to surround the heads of the nails to prevent easy removal of the nails and, hence, to discourage theft of the base and mailbox.

In those applications in which the mailbox base is to be mounted on a board or other flat mounting surface rather than to a post, the post-receiving portion can be eliminated from the base, or, alternatively, cut or sawed from the base along dotted line 49 as shown in FIG. 5 aligned with the lower edges 50 of the vertical walls of the base to permit the base to be properly mounted on a flat surface by extending nails through openings 60 in bottom wall 33.

First and second pairs of aligned openings 66 and 67 are provided in the lateral side walls 37 and 38 of the base beneath the bottom wall of the base and toward the front and back end, respectively, of the base (and of the mailbox mounted thereon) as best shown in FIG. 1.

The two pairs of aligned openings 66 and 67 comprise first and second indicator member support means, and an indicator member 68 is adapted to be selectively mounted to one of the pairs of openings. Indicator member 68 comprises a rectangular-shaped flap member which is sized to be received between one of the two pairs of openings 66 or 67 as shown in the Figs., and is attached to the base by extending screws 69 through the selected pair of openings into holes provided in the upper edges of the flap member in such a manner that the flap member is free to rotate relative to the base. A small magnetic strip 71 is affixed to a surface of the flap member and is positioned to be aligned with one of a pair of magnetic strips **72*a* or 72*b*** affixed to the lower surface of the base when the flap member is in a first, stand-by position as will be explained hereinafter.

As best shown in FIGS. 4 and 5, chamber 41 within base 10 contains an indicator member actuating means generally designated by reference numeral 51. Indicator member actuating means 51 comprises an actuating slide 52 and first and second trigger members 53 and 54.

Actuating slide 52 comprises an elongated, substantially flat bar which is positioned within chamber 41 adjacent lateral side wall 38, and which is of a length to extend from front side wall 34 to a position slightly spaced from back side wall 36. Actuating slide 52 is supported within chamber 41 to be slidable longitudinally between a forward position shown in FIG. 4 and a rearward position shown in FIG. 5. As shown in FIG. 4, when it is in its forward position, a portion **52*a* of the slide extends through a slot 57 in front side wall 34** for a distance of approximately three-fourths inch.

Actuating slide 52 is supported adjacent its back end by a slide holder 59 which conveniently comprises a component mounted within chamber 41 and formed with a cut-out portion **59*a* to define a slot between the component and lateral side wall 38 through which the slide extends. The front end of the slide is supported by slot 57 in front wall 34; however, additional support structure can be provided within chamber 41 if desired to ensure smooth movement of the slide. A spring 56 connected between actuating slide 52 and a wall of the base normally urges the actuating slide forwardly such that it is normally maintained in the forward position shown in FIG. 4**.

Actuating slide 52 includes a pair of cutout sections on its lower edge to define first and second inclined bearing surfaces 61 and 62. Bearing surfaces 61 and 62 are adapted to impinge against trigger members 53 and 54 when the actuating slide is moved from its forward position to its rearward position during operation of the apparatus. More particularly, first and second trigger members 53 and 54 comprise generally L-shaped members which are pivotally supported within chamber 41 for rotational movement between a first position shown in FIG. 4 substantially fully retracted into chamber 41, and a second position shown in FIG. 5 in which portions 53*a* and 54*a* thereof extend downwardly through narrow slots 63 and 64 in the bottom wall of the base.

To assemble the mailbox signalling apparatus of the present invention, a mailbox is first mounted to the base 12 by extending screws 42 through openings in the mailbox and the base as indicated previously. The base is then mounted to a post 45 or onto a flat support surface as also described above. The mail patron then determines whether the front or the back of the mounted mailbox faces his house. If the front of the mailbox faces his house, he normally attaches the flap member 68 to the front pair of openings 66, whereas if the back of the mailbox faces his house, he usually attaches the flap member to the back pair of openings 67. As indicated previously, this can be done quickly and easily by simply aligning the flap member between the selected pair of openings and inserting screws 69 through the openings into the upper edges of the flap member. The flap member is then raised to a substantially horizontal position as shown in FIGS. 2 and 4 and is retained in that position by the magnetic attraction between the magnet 71 on the flap and the aligned magnet 72*a* or 72*b* on the base depending on whether the flap is attached to the front or back pair of openings. The signalling apparatus is then ready to be operated when the mailbox is serviced.

Specifically, when the mailbox door 19 is opened, for example, by the mailman delivering mail, it is pivoted downwardly in the direction of arrow 25 in FIG. 5. As it is opened, its lower edge impinges upon extended portion 52*a* of actuator slide 52 and pushes the actuator slide rearwardly as indicated by arrow 81 in FIG. 5. As the actuator slide moves rearwardly, bearing surfaces 61 and 62 thereon impinge against trigger members 53 and 54 causing them to rotate downwardly from their position shown in FIG. 4 to their position shown in FIG. 5. As they rotate downwardly, the portions 53*a* and 54*a* thereof extend through the slots 63 and 64 in the bottom wall of the base. Depending on where the flap member has been mounted, the appropriate trigger member will push the indicator member positioned therebeneath downwardly breaking the magnetic attraction between the magnet 71 and the aligned magnet 72*a* or 72*b*. The flap member is then free to rotate within its mounting openings to a substantially vertical position where it is readily visible to the mail patron thus advising him that his mailbox has been serviced.

After removing his mail, the mail patron closes the mailbox door 19. Upon being moved to its closed position, the door releases the actuating slide 52 allowing spring 56 to automatically return the actuating slide to its forward position with extended portion 52*a* thereof extending through slot 57 in front wall 34. The flap member is then returned to its horizontal position by rotating it back to its horizontal, stand-by position until the magnet 71 thereon engages the aligned magnet on the base to be retained in the stand-by position. When the indicator flap is returned to its stand-by position, it pushes the aligned trigger member upwardly back to the position shown in FIG. 4, and the apparatus is ready to be again operated the next time the mailbox door is opened.

It should be noted that only the trigger member aligned with the indicator flap will be returned to its FIG. 4 position when the flap is raised. The unused trigger member will remain in its down position during the second and all subsequent operations of the apparatus.

With the present invention, a mail patron can ensure that the indicator member is readily visible from his house or from another desired location by selectively mounting the indicator member to either the front or the back indicator member support openings. The signalling apparatus of the invention is thus effective whether the patron's mailbox is on the same side of or across the street from his house. Preferably, the indicator member is colored a bright red or another highly visible color so that it can be easily seen from a substantial distance.

Usually a mail patron will mount the indicator member to either the front or the back of the mailbox base. If desired, however, an indicator member can be mounted to both the front and the back indicator member support means as shown in many of the Figs. to provide visibility from all directions.

The actuating slide and the trigger members are substantially fully enclosed within the base 12 at all times and are thus well-protected from the weather and from vandals. The base 12 and the indicator flap are preferably formed of a rigid plastic material whereas the actuating slide and the trigger members can be made of steel since they are protected from the weather. The base 12 including the downwardly extending, post-receiving portion 43 thereof can conveniently be made of a single piece of molded plastic.

While what has been described constitutes a presently preferred embodiment of the invention, it should be recognized that the invention could take numerous other forms. For example, rather than being mounted to the base by screws, the indicator member can be mounted on a telescoping shaft and simply inserted into one of the pairs of aligned openings in the base. This would avoid the need of even a screwdriver to mount or remove the flap. Because the invention can be varied in many ways, it should be understood that the invention should be limited only insofar as is required by the scope of the following claims.

I claim:

1. Mailbox signalling apparatus for a mailbox having a front end and a back end and a closure member mounted on the front end which is adapted to be pivotally moved from a closed position to an open position, said signalling apparatus comprising:

a base for supporting said mailbox;

a first indicator member support means on said base for supporting an indicator member toward the front end of said mailbox;

a second indicator member support means on said base for supporting an indicator member toward the back end of said mailbox;

an indicator member selectively supported by one of said first or second indicator member support means for movement between a first, stand-by position and a second, signalling position; and actuating means on said base for actuating said indicator member for movement from said first, stand-by position to said second, signalling position when said closure member is pivotally moved from a closed position to an open position.

2. The apparatus as recited in claim 1 wherein said indicator member comprises an indicator flap, and wherein said first and second indicator member support means comprise first and second means for supporting said indicator flap for pivotal movement between a first, substantially horizontal stand-by position and a second, substantially vertical, signalling position.

3. The apparatus as recited in claim 2 and further including means for normally retaining said indicator flap in said first, substantially horizontal, stand-by position.

4. The apparatus as recited in claim 3 wherein said retaining means comprises magnetic retaining means.

5. The apparatus as recited in claim 4 wherein said magnetic retaining means comprises first magnet means affixed to said base and second magnet means affixed to said indicator flap.

6. The apparatus as recited in claim 3 wherein said actuating means comprises an actuator slide supported on said base for movement between a first, forward position and a second, rearward position; and first and second trigger members adapted to be operated by said actuating slide when said actuating slide is moved from said first, forward position to said second, rearward position, said actuating slide including a portion adapted to be engaged by said closure member when said closure member is pivotally moved from said closed position to said open position to move said actuating slide from said first, forward position to said second, rearward position to operate said first and/or second trigger members to actuate said indicator flap for movement from its first, stand-by position to its second, signalling position.

7. The apparatus as recited in claim 6 wherein said first and second trigger members are pivotally mounted to said base, and wherein said actuating slide includes first and second bearing surfaces for engaging said first and/or second trigger members, respectively, to pivot said first and/or second trigger members downwardly to disengage said retaining means and to permit said indicator flap to pivot downwardly to its second, signalling position.

8. The apparatus as recited in claim 6 and further including spring means for normally urging said actuating slide to said first, forward position.

9. The apparatus as recited in claim 2 wherein said first and second indicator member support means comprise first and second pairs of aligned holes in said base for selectively supporting said indicator flap therebetween.

10. The apparatus as recited in claim 1 wherein said base includes bottom and side walls defining a chamber therein which is adapted to be covered by said mailbox, and wherein said actuating means is supported by said base substantially fully enclosed within said chamber.

11. The apparatus as recited in claim 1 wherein said base includes an integral post mounting portion extending downwardly from the bottom wall of said base for mounting said base to a post.

12. Mailbox signalling apparatus for indicating when a mailbox has been serviced, said signalling apparatus being adapted for use with a rural-type mailbox having an open front end and a back end and a closure member adapted to be pivoted downwardly to open the front end of the mailbox, said signalling apparatus comprising:

a base for supporting said mailbox, said base having a bottom wall, and side walls for defining a chamber adapted to be covered by said supported mailbox;

front indicator member support means on said base for supporting an indicator member toward the front end of the base;

back indicator member support means on said base for supporting an indicator member toward the back end of the base;

an indicator member selectively supported beneath said base by either said front or said back indicator member support means for pivotal movement between a first, substantially horizontal, stand-by position and a second, substantially vertical signalling position;

indicator member retaining means for normally retaining said indicator member in said first, substantially horizontal, stand-by position; and indicator member actuating means in said chamber and operated by said closure member when said closure member is pivoted downwardly to open said mailbox to disengage said indicator member retaining means to allow said indicator member to pivot downwardly from its first, substantially horizontal stand-by position to its second, substantially vertical, signalling position.

13. The apparatus as recited in claim 12 wherein said front and back indicator member support means comprise front and back pairs of aligned openings in lateral side walls of said base for supporting said indicator member for pivotal movement therebetween.

14. The apparatus as recited in claim 13 wherein said indicator member retaining means includes a first pair of magnets affixed to the bottom wall of said base adjacent said front and back indicator member support means, respectively, and a second magnet affixed to said indicator member so as to be aligned with one of said first pair of magnets depending on whether said indicator member is mounted to said front or said back indicator member support means.

15. The apparatus as recited in claim 12 wherein said actuating means comprises an actuator slide supported on said base for movement between a first, forward position and a second, rearward position; and first and second trigger members adapted to be operated by said actuating slide when said actuating slide is moved from said first, forward position to said second, rearward position, said actuating slide including an extended portion adapted to be engaged by said closure member when said closure member is pivoted downwardly to open the front end of the mailbox to move said actuating slide from said first, forward to said second, rearward position to thereby operate said first and/or second trigger members to disengage said indicator member retaining means to allow said indicator member to pivot downwardly from its first, stand-by position to its second, signalling position.

16. The apparatus as recited in claim 15 wherein said extended portion of said actuating slide extends through a slot in a front side wall of said base when said actuating slide is in said first, forward position.

17. The apparatus as recited in claim 15 wherein said first and second trigger members are pivotally mounted to said base, and wherein said actuaing slide includes first and second bearing surfaces for engaging said first and/or second trigger members when said slide is moved from said first, forward position to said second, rearward position to pivot said first and/or second trigger members downwardly to push said indicator member downwardly to disengage said indicator member retaining means.

18. The apparatus as recited in claim 17 wherein said first and second trigger members include portions adapted to extend through slots in said bottom wall of said base when said first and/or second trigger members pivot downwardly.

* * * * *